US007311544B1

(12) United States Patent
Berta

(10) Patent No.: US 7,311,544 B1
(45) Date of Patent: Dec. 25, 2007

(54) CONNECTOR LOCKING DEVICE

(75) Inventor: Erin Burgin Berta, Novato, CA (US)

(73) Assignee: Alcatel Lucent, Paris ( * ) Notice: Subject to any disclaimer, the term of this patent is extended or adjusted under 35 U.S.C. 154(b) by 0 days.

(21) Appl. No.: 11/683,129

(22) Filed: Mar. 7, 2007

(51) Int. Cl.
*H01R 13/625* (2006.01)
*H01R 4/50* (2006.01)

(52) U.S. Cl. ..... 439/344; 439/352; 439/350

(58) Field of Classification Search ..... 439/344, 439/352, 304, 373, 350, 357, 358, 369, 354
See application file for complete search history.

(56) References Cited

U.S. PATENT DOCUMENTS 5,462,457 A * 10/1995 Schroepfer et al. ..... 439/736

* cited by examiner

*Primary Examiner*—Javaid H. Nasri
(74) *Attorney, Agent, or Firm*—Gardner Groff Greenwald & Villanueva, P.C.; Bobby D. Slaton

(57) ABSTRACT

A locking device for securing a plug in a jack has a housing with a tang and an adjustable clamp with a lip. The housing fits over the plug with the tang blocking a latch arm of the plug from being moved to release the plug from the jack. The clamp is movable to a locked position with the lip engaging the catch surface to prevent the housing from being removed from the mounting position.

20 Claims, 5 Drawing Sheets

CONNECTOR LOCKING DEVICE

BACKGROUND OF THE INVENTION

1. Field of the Invention

The present invention relates generally to electrical connectors and, more specifically, to a locking device for preventing a plug from being removed from a jack.

2. Description of the Related Art

The set-top box that cable television service providers have long provided to their residential customers to interface a television set with the cable television network is rapidly being supplanted by more technologically advanced types of customer premises equipment that serve as gateways for interfacing a variety of electronic devices to service providers' digital networks. For example, service providers who operate passive optical networks may provide an optical network terminator (ONT, also known as optical network unit) at the customer premises, to which one can connect various devices, such as Ethernet local area network (LAN) servers, telephones, and televisions. In instances in which both the ONT and the Ethernet device are provided by the service provider, the service provider may wish to prevent the customer from tampering with the equipment.

But the connectors that are commonly used to connect such devices, such as the RJ45 connector plug 10 and jack 12 shown in FIGS. 1 and 2, are intended to be readily removable. The plug 10 has a body 14 with a resilient latch arm 16 extending from it. The latch arm 16 is ramped so that it resiliently deflects and easily slides into the jack 12, then it resiliently returns to its neutral position where cooperating catch surfaces hold it in the jack until the latch arm is depressed. On of opposite side of the latch arm 16 is a shoulder 18 that extends laterally from the plug body 14. When the plug 10 is stalled in the jack 12, the shoulder 18 extends laterally across and is spaced apart from the jack. Before installing the plug 10 in the jack 12, a line 20 such as a cable is connected to the plug. In this configuration, the plug 10 is easily installed and easily removed from the jack 12.

Accordingly, there is nothing to prevent a customer or otherwise unauthorized person from unplugging connectors such as those of Ethernet cables from devices such as the above-mentioned ONT. The present invention addresses these problems and deficiencies and others in the manner described below.

SUMMARY OF THE INVENTION

The present invention relates to a locking device for securing a male connector plug in a female connector jack to prevent unauthorized disconnection. The locking device has a housing and an adjustable clamp that moves within (or otherwise relative to) the housing between an unlocked and a locked position. The housing has a tang projecting from it, and when the housing is placed in a mounting position on the plug, this places the tang in a blocking position adjacent the resilient latch arm of the plug/jack assembly to prevent the latch arm from being actuated. In this way, as long as the housing is retained in the mounting position, the tang prevents the plug from being removed from the jack. In addition, the adjustable clamp has a lip projecting from it, and when the clamp is moved within the housing to the locked position, the lip comes into engagement with a lateral catch surface of the plug/jack assembly. For embodiments designed for use with standard RJ45 connectors, the clamp lip is configured to fit between the plug shoulder and the jack to engage a lateral catch surface formed by the shoulder. In this way, as long as the clamp is retained in the locked position, the clamp lip prevents the housing from being removed from the plug.

In example embodiments, the housing has generally aligned plug openings through which the plug fits to install the housing onto the plug with the clamp withdrawn to the unlocked position. In this way, the locking device can be installed on a plug that has already been installed on a line, so that the locking device does not have to be assembled onto and provided only with new cable lines.

Also, in the example embodiments, the clamp body from which the lip extends is generally U-shaped with lateral arms. When the clamp is in the locked position, the lateral arms capture the plug body against an inner wall of the housing with such little or no play that the lip cannot be forced from engagement with and past the catch surface. This keeps the lip engaged against the catch surface, which in turn keeps the tang in the blocking position to prevent plug removal.

In other aspects, the housing may have a well that receives the latch arm when the housing is in the mounting position. And the housing may have one or more clamp openings for inserting the clamp into the housing, with each clamp opening including a recess for the lip and a recess for the lateral arms.

DETAILED DESCRIPTION

Figure 1:
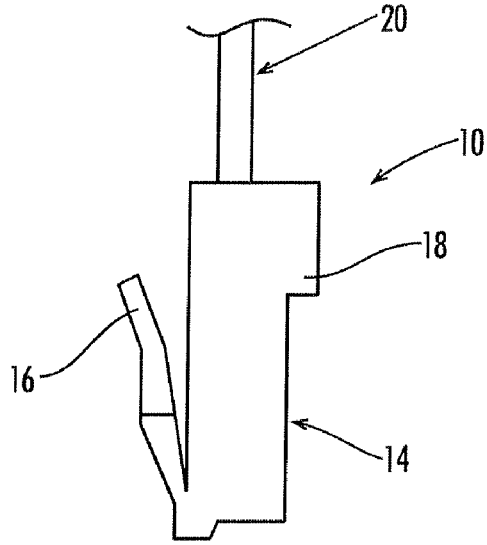
Prior Art Fig. 1
FIG. 1 is a side view of a prior art RJ45 connector plug.
Figure 2:
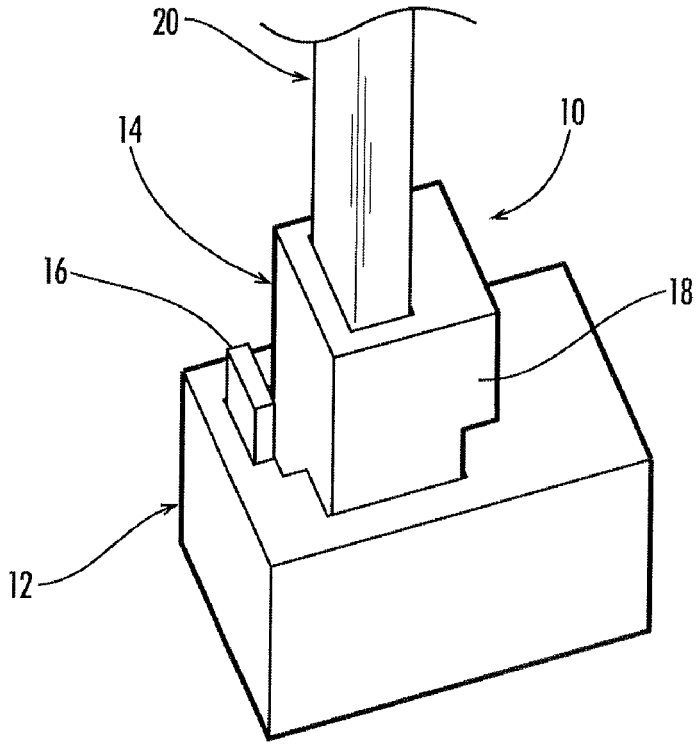
Prior Art Fig. 2
FIG. 2 is a perspective view the RJ45 connector plug of FIG. 1 installed in a mating prior art RJ45 connector jack.
Figure 3:
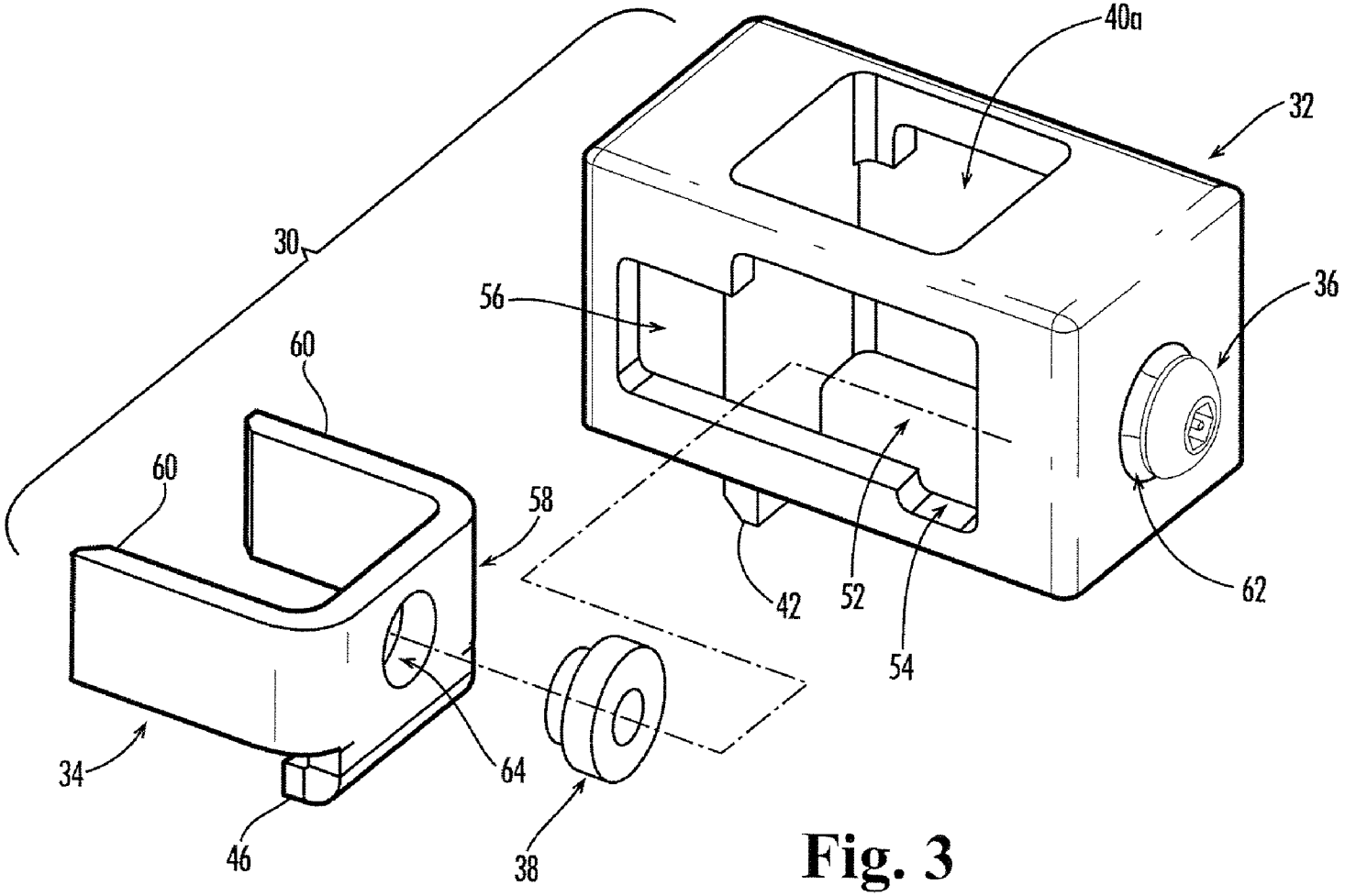
FIG. 3 is an exploded perspective view of a locking device according to an example embodiment of the present invention, showing a housing, a movable clamp, and a security fastener.
Figure 4:
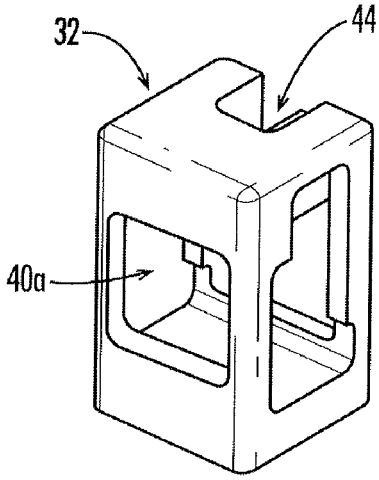
FIG. 4 is a top front perspective view of the housing of FIG. 3.
Figure 5:
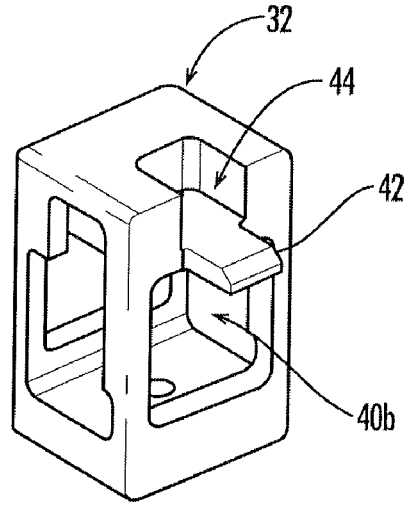
FIG. 5 is a top rear perspective view of the housing of FIG. 4.
Figure 6:
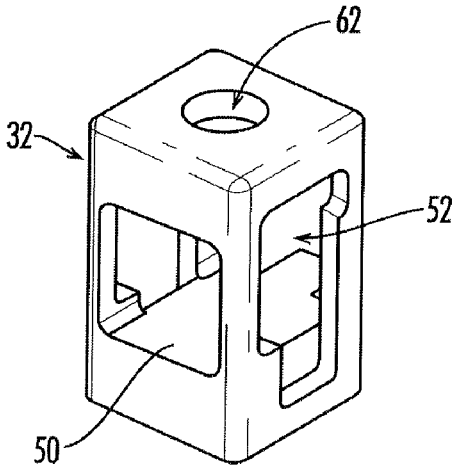
FIG. 6 is a bottom front perspective view of the housing of FIG. 4.
Figure 7:
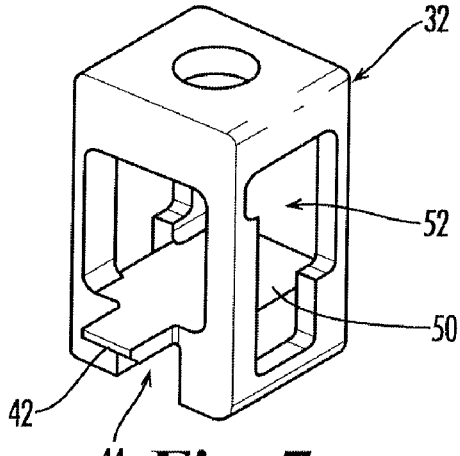
FIG. 7 is a bottom rear perspective view of the housing of FIG. 4.
Figure 8:
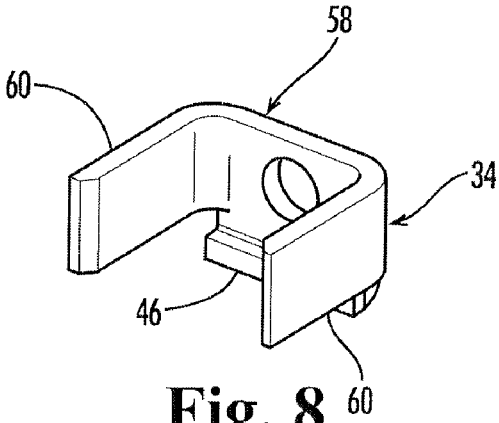
FIG. 8 is a perspective view of the movable clamp of FIG. 3.
Figure 9:
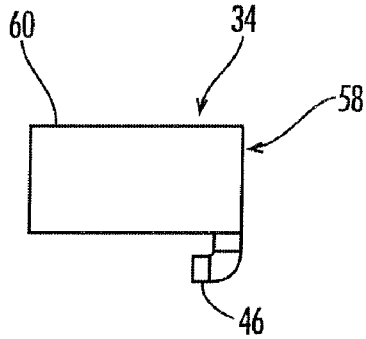
FIG. 9 is a side view of the movable clamp of FIG. 8.
Figure 11:
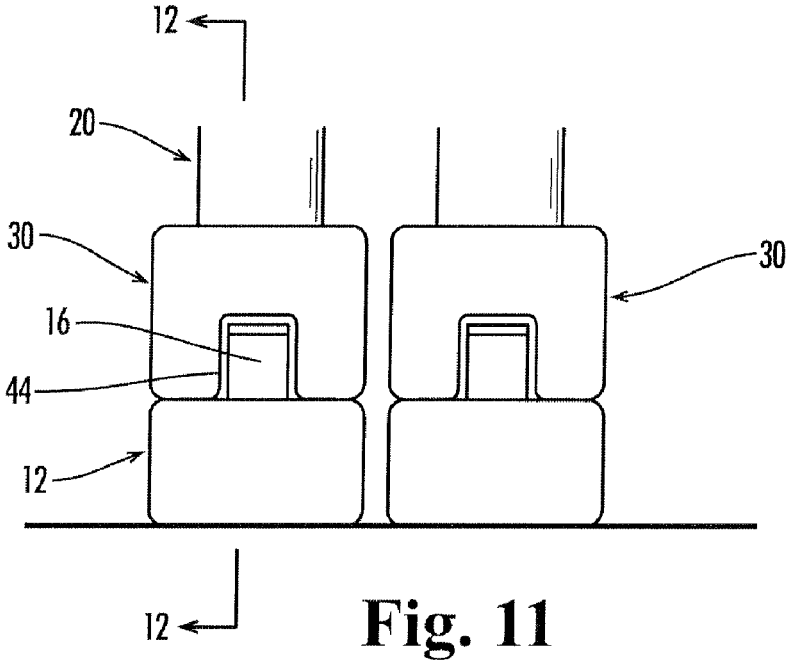
FIG. 11 is an end view of two of the locking devices of FIG. 3 installed on two adjacent connector plug and jack assemblies of FIG. 2.
Figure 10:
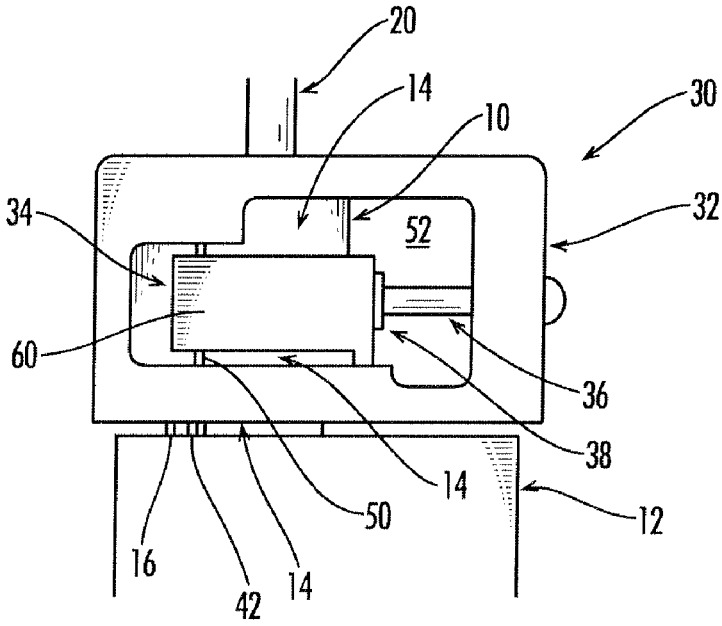
FIG. 10 is a side view of the locking device of FIG. 3 installed on the connector plug and jack assembly of FIG. 2.

FIGS. 3-13 show a locking device 30 according to an example embodiment of the present invention. The locking device 30 is configured for use with the conventional RJ45 plug 10 and jack 12 connector of FIGS. 1 and 2, and is described in detail for illustrative purposes only. The scope of the invention includes other embodiments with modified configurations for use with other similar types of connectors.

Referring to FIGS. 3-9, the locking device 30 includes a housing 32, a clamp 34, a security fastener 36, and a bushing 38. The housing 32 receives the clamp 34, the bushing 38 couples to the clamp 34, and the security fastener 36 couples to the bushing and the housing to move the clamp between an unlocked position and a locked position. In the depicted example embodiment, the housing 32 is generally rectangular and made of DELRIN, and the clamp 34 is generally U-shaped and made of an aluminum alloy with a chrome finish. In alternative embodiments, the major components of the locking device 30 can have other configurations and be made of other materials selected for high strength/durability and low cost. In other alternative embodiments, the bushing 38 is eliminated and the security fastener 36 couples directly to the clamp 34. Furthermore, the size and shape of the housing 32 preferably permit two or more of the locking devices 30 to be installed at adjacent jacks/ports (see FIG. 11).

Figure 12:
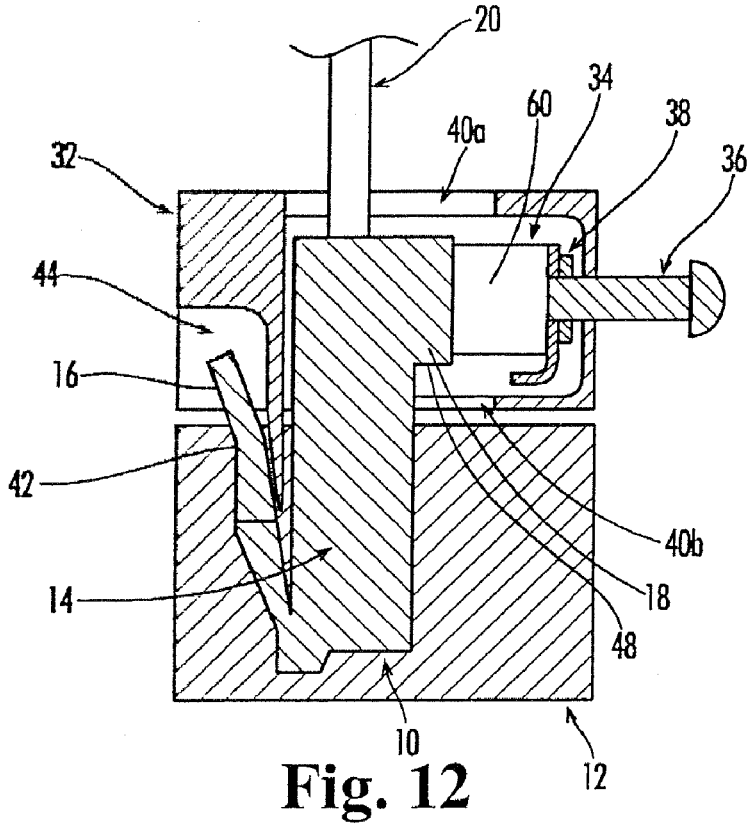
FIG. 12 is a cross-sectional view, taken at line 12-12, of the locking device and the connector plug and jack assembly of FIG. 11, showing a tang of the locking device in a latch-blocking position and the movable clamp in an unlocked position.
Figure 13:
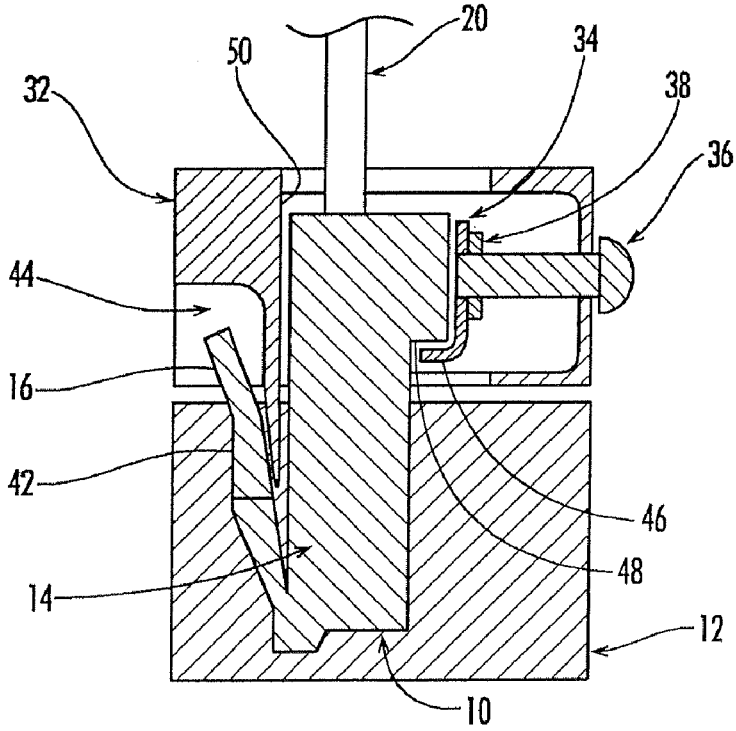
FIG. 13 is a cross-sectional view of the locking device and the connector plug and jack assembly of FIG. 12, showing the movable clamp in a locked position.

Referring additionally to FIGS. 10-13, details of the structure and use of the locking device 30 of the example embodiment will now be described. The housing 32 has first and second generally aligned plug openings 40*a* and 40*b* (collectively the "plug openings 40") through which the entire plug 10 fits to install the locking device on the plug 10. Preferably, the plug openings 40 are sized and shaped to receive the plug 10 through them with little extra space to minimize cutouts and thus make the housing 32 stronger. In addition, the housing 32 has a tang 42 extending from it. The tang 42 may be in the form of a tab, bar, pin, tapered arm, or other projecting member, whether integrally formed with the housing 32 or assembled thereto. When the housing 32 is in a mounted position, as is depicted in FIGS. 10-13, a portion of the plug body 14 is received in the housing and the tang 42 is in a blocking position. In the blocking position, the tang 42 is interposed between the latch arm 16 and the plug body 14 to prevent the latch arm from being depressed to release the plug 10 from the jack 12, as is best seen in FIGS. 12 and 13. Also, the housing 32 has a well 44 that receives the latch arm 16 when the housing is in the mounted position. In the depicted embodiment, the well 44 is formed in part by the tang 42 of the housing 32.

The clamp 34 is movable relative to the housing 32 between unlocked and locked positions, and has a lip member 46 that engages with a catch surface 48 of the plug 10 when in the locked position. The lip 46 may be in the form of an arm, tab, ledge, flange, or other projecting member. In the example embodiment for use with a conventional RJ45 connector, the lip 46 engages the catch surface 48 that is defined by the shoulder 18 of the plug 10. When the clamp 34 is in the unlocked position depicted in FIG. 12, the lip 46 is withdrawn from engagement with the catch surface 48. In this position, the housing 32 can be slipped over the plug 10 and onto the line 20 before the plug is inserted into the jack 12. When the clamp 34 is moved into the locked position depicted in FIGS. 10 and 13, the lip 46 is moved into the space between the plug shoulder 18 and the jack 12. In the locked position, the lip 46 engages the catch surface 48 to prevent the housing 32 from being removed from the mounting position. Also, in the locked position, the plug body 14 within the housing 32 is positioned between the clamp 34 and an inner wall 50 of the housing. In that position, the plug body 14 is captured between the clamp 34 and the inner wall 50 with such little or no play that the clamp lip 46 cannot be forced past the catch surface 48 to remove the housing 32 from the mounted position. In the depicted embodiment, the inner wall 50 is formed in part by the tang 42 of the housing 32, on the opposite side of the tang from the well 44.

In addition, the clamp 34 is positioned within the housing 32, at least partially so, when the clamp is in the locked position. In order to insert the clamp 34, the housing 32 has one or two clamp openings 52 through which the clamp fits. Preferably, the clamp openings 52 are sized and shaped to receive the clamp 34 through them with little extra space to minimize cutouts and thus make the housing 32 stronger. Thus, the clamp openings 52 preferably each include a lip recess 54 through which the clamp lip 46 fit.

Furthermore, the clamp 34 of the depicted embodiment has a U-shaped body 58 from which the lip 46 extends and with two lateral arms 60 that receive the plug body 14 between them. The lateral arms 60 are dimensioned to extend laterally across the plug 10, and then some additional length, when the clamp 34 is in the locked position. This allows the clamp 34 to secure plugs with some dimensional differences, and more securely holds the plug 10 in place. To accommodate this, the clamp openings 52 include arm recesses 56 that receive the lateral arms 60 with the inner wall 50 between them when the clamp 34 is in the locked position. As used herein, "lateral" means in a direction perpendicular to the axial direction defined by the line 20 running through the plug 10.

As mentioned above, the security fastener 36 is adjustable to move the clamp 34 between the unlocked and the locked positions. Preferably, the security fastener 36 has a custom or non-standard locking feature, such as the hex/pin-style head of the security screw depicted. Because a special tool is required to loosen the security screw for removing the locking device 30, the average person (not having the special tool needed) could not readily remove the locking device, and many people would be discouraged from attempting to do so. In the example embodiment shown, the security screw 36 is matingly received through a threaded aperture 62 in the housing 32. Alternatively, the security fastener can be provided by a push-lock fastener, a sleeve or barrel nut, a partition or socket-cap screw, a binding post, a tie-strap, or another conventional tamper-resistance or tamper-proof fastener. In other included embodiments, a standard screw (e.g., flat-head or Phillips-head) or other standard (non-security) fastener can be used. Although RJ45 connectors are the well-known standard for Ethernet connections, they are also well-known for not being a very robust connection. Thus, the locking device 30 with a standard (non-security) fastener is generally useful in all applications for providing a more secure cable connection, as well as in those applications where restricting plug removal is less of a concern.

In other aspects, the present invention includes a method of assembling a locking device for a connector and a method using a locking device to secure a connector. To assemble the locking device 30 for use, the bushing 38 is inserted into an aperture 64 in the clamp 34, and the clamp 34 is inserted through one of the clamp openings 52 and into the housing 32. Then the security screw 36 is tightened through the housing aperture 62 until it extends into the housing, and the clamp 34 is moved toward the screw to frictionally couple the bushing 38 to the screw. The clamp 34 is now in the unlocked position and ready for use.

To use the locking device 30, the plug 10 is slipped all the way through the plug openings 40 of the housing 32 until the latch arm 16 clears the housing and resiliently returns to its neutral position. Now the housing 32 is all the way past the plug 10 and on the line 20. Then the plug 10 is inserted into the jack 12 to make the needed connection. Next the housing 32 is moved back onto the plug 10. With the latch arm 16 having resiliently returned to its neutral position, the housing tang 42 slips between the latch arm and the plug body 14. The housing 32 is now in the mounted position with the tang 42 blocking the latch arm 16 from being depressed to release the plug 10 for disconnection from the jack 12. Then the security screw 36 is tightened, which pushes the clamp 34 laterally towards the plug 12 in the housing 32, which in turn moves the clamp to the locked position. In the locked position, the clamp lip 46 engages the catch surface 48 on the shoulder 18 of the plug 10, which prevents the housing 32 from being forcibly removed from the plug. In other words, the housing tang 42 prevents the plug 10 from being removed from the jack 12, and the clamp lip 46 prevents the housing tang from being removed from the plug.

The locking device 30 can later be removed by authorized personnel, as may be desired. First the security screw 36 is loosened to move the clamp 36 to the unlocked position. Then the housing 32 is removed from over the plug 10, which removes the tang 42 from the blocking position, and slipped back onto the line 20. The plug 10 can now be removed from the jack 12. Finally, if the locking device 30 is to be used on another connector, the plug 10 can be slipped back through the housing 32 and out of the other side to separate the locking device from the plug.

Although in the illustrated embodiments of the invention the locking device has a structure adapted to secure an RJ45 type of plug into a corresponding RJ45 type of jack (or "port" in the context of a device such as ONT), in other embodiments it can be adapted to secure other types of plugs. The type commonly referred to in the art as RJ45 is itself a variety of eight-position, eight-conductor ("8P8C") modular connector having a structure and dimensions as specified by the standard known as TIA-968-A, published by the Administrative Council for Terminal Attachment (ACTA) of the Telecommunications Industry Association (TIA). The most common use for an RJ45 plug is in Ethernet cables. Other plugs having a similar appearance are known as Registered Jacks (RJ), also referred to as modular connectors, and include, for example, RJ11, RJ14 and RJ25, just to name a few. The present invention is applicable to any suitable Registered Jack, 8P8C, or similar modular connector having a block-like body and a resilient latch arm that can be retained by and blocked by the locking device described and illustrated herein. It is likewise applicable to the method of securing any other suitable cable to customer premises equipment such as an ONT provided by a service provider.

In an alternative embodiment, the clamp body is not U-shaped and does not have the lateral arms, and thus has a smaller lateral dimension so that it fits through one of the plug openings, thereby eliminating the need to include any clamp openings. In this embodiment, the housing has walls where the clamp openings would otherwise be, and these walls are used with the clamp and the housing inner wall to capture the plug so that the clamp lip cannot be forced past the catch surface.

In another alternative embodiment, the locking device is configured for use with a non-standard plug and jack connector without a shoulder but with a channel, gap, or slot defining the catch surface on the plug or the jack, and with the clamp lip extending into engagement with the catch surface. In some of these embodiments, the clamp lip extends out of the housing. And in still another alternative embodiment, the locking device is configured for use with a non-standard plug and jack connector with the latch arm on the jack and with the tang extending to a position between the latch arm and a body of the jack.

It will be apparent to those skilled in the art that various modifications and variations can be made to this invention without departing from the spirit or scope of the invention. Thus, it is intended that the present invention cover the modifications and variations of this invention provided that they come within the scope of any claims and their equivalents. With regard to the claims, no claim is intended to invoke the sixth paragraph of 35 U.S.C. Section 112 unless it includes the term "means for" followed by a participle.

What is claimed is:

1. A locking device for securing a plug in a jack, the plug and jack assembly having a resilient latch arm and a catch surface, the locking device comprising:

a housing having a tang extending therefrom, wherein in a mounted position the housing receives at least a portion of the plug therein with the tang blocking the latch arm from being moved to release the plug from the jack; and a clamp having a lip, wherein the clamp is movable relative to the housing to a locked position with the lip engaging the catch surface to prevent the housing from being removed from the mounted position.

2. The locking device of claim 1, wherein the plug has a body and the latch arm extends therefrom, and wherein when the housing is in the mounted position the tang is positioned between the latch arm and the body of the plug.

3. The locking device of claim 2, wherein the housing defines an inner wall, and wherein when the clamp is in the locked position the plug body is positioned between the inner wall and the clamp with such little or no play that the lip cannot be moved past the catch surface to remove the housing.

4. The locking device of claim 3, wherein the tang defines at least a portion of the inner wall.

5. The locking device of claim 1, wherein the plug has a shoulder that defines the catch surface, wherein when the plug is installed in the jack the shoulder is spaced apart from the jack, and wherein when the clamp is in the locked position the lip is positioned between the shoulder and the jack.

6. The locking device of claim 1, wherein the plug is mounted on a line, and wherein the housing defines first and second generally aligned plug openings through which the entire plug fits when the clamp is in an unlocked position with the lip withdrawn from engagement with the catch surface, wherein housing can be slipped over the plug and onto the line before the plug is inserted into the jack.

7. The locking device of claim 1, wherein the clamp is at least partially positioned within the housing, and the housing defines at least one clamp opening through which the clamp inserts into the housing.

8. The locking device of claim 7, wherein the clamp opening includes a lip recess through which the clamp lip inserts into the housing.

9. The locking device of claim 1, wherein the housing defines a well that receives the latch arm when the housing is in the mounted position.

10. The locking device of claim 1, wherein the clamp has a U-shaped body from which the lip extends, wherein the U-shaped body receives the plug.

11. The locking device of claim 1, further comprising a fastener that is adjustable to move the clamp to the locked position.

12. The locking device of claim 11, wherein the fastener comprises a security screw.

13. A locking device for securing a plug in a jack, the plug mounted on a line and plug having a body, a resilient latch arm extending therefrom, and a shoulder defining a catch surface, the locking device comprising:

a housing having an extension tang, defining an inner wall, and defining first and second generally aligned plug openings through which the entire plug fits, wherein when the housing is in a mounted position at least a portion of the plug body is received in the housing and the tang is in a blocking position between the latch arm and the plug body to prevent the latch arm from being moved to release the plug from the jack;

a clamp having a lip, wherein the clamp is movable relative to the housing between unlocked and locked positions, wherein when the clamp is in the unlocked position the lip is withdrawn from engagement with the catch surface and the housing can be slipped over the plug and onto the line before the plug is inserted into the jack, wherein when the clamp is in the locked position the lip is positioned between the shoulder and the jack with the lip engaging the catch surface to prevent the housing from being removed from the mounting position, and wherein when the clamp is in the locked position the plug body is positioned between the inner wall and the clamp with such little or no play that the lip cannot be moved past the catch surface to remove the housing from the mounted position; and a security fastener that is adjustable to move the clamp to the locked position.

14. The locking device of claim 13, wherein the tang defines at least a portion of the inner wall.

15. The locking device of claim 13, wherein the clamp is at least partially positioned within the housing, and the housing defines two clamp openings through which the clamp is receivable into the housing.

16. The locking device of claim 15, wherein the clamp openings each include a lip recess through which the clamp lip is receivable into the housing.

17. The locking device of claim 15, wherein the clamp has a U-shaped body from which the lip extends, the U-shaped body has two lateral arms that receive therebetween the plug body, and the clamp openings include arm recesses that receive the lateral arms with the inner wall between the lateral arms when the clamp is in the locked position.

18. The locking device of claim 13, wherein the housing defines a well that receives the latch arm when the housing is in the mounted position.

19. The locking device of claim 13, wherein the clamp has a U-shaped body from which the lip extends, wherein the U-shaped body receives the plug body.

20. The locking device of claim 13, wherein the housing defines a threaded aperture and the security fastener comprises a screw that is matingly received by the threaded aperture.

* * * * *